United States Patent [19]

Enjo et al.

[11] Patent Number: 4,659,505

[45] Date of Patent: Apr. 21, 1987

[54] AZEOTROPIC LIKE COMPOSITION

[75] Inventors: Naonori Enjo, Suita; Yukio Omure, Takatsuki, both of Japan

[73] Assignee: Daikin Kogyo Co., Ltd., Osaka, Japan

[21] Appl. No.: 830,800

[22] Filed: Feb. 19, 1986

[30] Foreign Application Priority Data

Feb. 20, 1985 [JP] Japan ..... 60-32329

[51] Int. Cl.[4] ..... B01F 1/00; C23G 5/28; C23G 5/32; C23G 5/36

[52] U.S. Cl. ..... 252/364; 252/194; 252/170; 252/171; 252/172; 252/DIG. 9

[58] Field of Search ..... 252/194, 364, 170–172, 252/DIG. 9

[56] References Cited

U.S. PATENT DOCUMENTS

| | | | |
|---|---|---|---|
| 3,431,211 | 3/1969 | Bauer et al. | 252/172 |
| 3,833,507 | 9/1974 | Schofield et al. | 252/171 |
| 3,888,693 | 6/1975 | Schevey et al. | 134/102 |
| 3,903,009 | 9/1975 | Bauer et al. | 252/171 |
| 3,903,012 | 9/1975 | Brandreth | 252/194 |
| 3,925,010 | 12/1975 | Barton | 252/DIG. 9 X |
| 3,960,746 | 6/1987 | Gorski | 252/171 |
| 4,378,303 | 3/1983 | Hisamoto et al. | 252/364 |
| 4,517,108 | 5/1985 | Hisamoto et al. | 252/172 X |
| 4,578,209 | 3/1986 | Hisamoto et al. | 252/172 X |

FOREIGN PATENT DOCUMENTS

| | | | |
|---|---|---|---|
| 105427 | 4/1984 | European Pat. Off. | 252/172 |

*Primary Examiner*—Herbert B. Guynn
*Assistant Examiner*—Matthew A. Thexton
*Attorney, Agent, or Firm*—Armstrong, Nikaido, Marmelstein & Kubovcik

[57] ABSTRACT

An azeotropic like composition comprising 95 to 93% by weight of Flon-112 and 5 to 7% by weight of isooctane. The composition has a lower freezing point than that of Flon-112 while maintaining excellent properties of Flon-112. The composition is useful as various solvents and dispersing media such as a cleaning solvent, an extraction solvent, a dispersing medium.

1 Claim, No Drawings

AZEOTROPIC LIKE COMPOSITION

BACKGROUND OF THE INVENTION

The present invention relates to an azeotropic like composition comprising 95 to 93% (% by weight) of tetrachlorodifluoroethane (hereinafter referred to as "Flon-112") and 5 to 7% of isooctane. The composition has a boiling point of 92.5° to 92.7° C.

Recently, importance of washing process is increasing with advance in miniturization and precision of parts in electronic field. For washing them, chlorofluorohydrocarbon solvents are employed because of their various advantages such as incombustibility, low toxity and selective solubility that they can dissolve fats, oils, grease and the like without erosion of high molecular compounds such as rubbers and plastics.

Examples of the chlorofluorohydrocarbon solvents used for washing are trichlorotrifluoroethane (hereinafter referred to as "Flon-113") which is chemically stable and safe, an azeotropic mixed solvent thereof and the like.

When temporarily fixing silicon wafers used for semiconductors, quartz, ceramics and the like in their processing such as cutting or polishing, waxes are used. Removal of the waxes by dissolving or peeling off, however, is essentially impossible by employing Flon-113 or an admixtures thereof because Flon-113 has a relatively low boiling point of 47.6° C.

Flon-112 is a suitable solvent to the waxes of a relatively high melting point used for the temporary fixing because Flon-112 has a high boiling point of 92.8° C. However, since Flon-112 has a high freezing point and becomes solid at a low temperature, it is hard to use in winter season, which limits width of its use. In addition, Flon-112 cannot be used as an extraction solvent for purifying waxes having a high melting point such as bees wax and Japan wax, because Flon-112 becomes solid on cooling.

Heretofore though there has been proposed a method for lowering the freezing point of Flon-112 in which various organic solvents such as alcohols, ketones or esters are admixed with Flon-112 to form mixed solvents of two-component system or three-component system which include an azeatropic system, many solvents obtained by the method sacrifice one or more useful advantageous properties of Flon-112. That is, those solvents are chemically unstable, flammable, or have a relatively high toxity. Azeotropic solvents of Flon-112 with solvents having a high solubility have a danger that they harm materials made of rubbers or plastics.

The present invention has done to provide an azeotropic like composition which can solve the disadvantages derived from the high freezing point of Flon-112 while keeping the above-mentioned excellent properties of Flon-112, and does not harm materials made of rubbers or plastics, and also is incombustible, chemically stable, and has an essentially constant boiling point.

SUMMARY OF THE INVENTION

According to the present invention, there is provided an azeotropic like composition comprising 95 to 93% of Flon-112 and 5 to 7% of isooctane.

The composition has a freezing point of 9° to 5° C. and a boiling point of 92.5° to 92.7° C.

The words "azeotropic like composition" as used herein means a liquid composition which has a constant boiling point lower than every boiling point of each component, and does not change in proportion of components when the composition is distilled.

DETAILED DESCRIPTION OF THE INVENTION

The composition of the present invention has excellent electrical properties such as electroinsulating property and breakdown voltage, and does not harm materials made of rubbers or plastics, and has almost the same chemical stability as that of Flon-112, and also can provide a solvent having a high boiling point. Accordingly the composition can remove the above-mentioned waxes and other greases having a high boiling point, and also is usable as an extraction solvent for waxes having a high boiling point such as bees wax. Further since the composition can form an azeotropic mixture which is incombustible and has an essentially constant boiling point, it is very easy to control the liquid composition and to recover by distillation.

Though the composition of the present invention has almost the same chemical stability as that of Flon-112, the stability is slightly lower than that of Flon-113. Therefore stabilizers may be added to the composition.

It is preferred that the stabilizers can be distilled together with the composition, more desirably can form an azeotropic system, in addition that the stabilizers have a large stabilizing effect against the composition.

Examples of the stabilizers are, for instance, aliphatic nitro compounds such as nitromethane, nitroethane and nitropropane; acetylene alcohols such as 3-methyl-1-butyne-3-ol and 3-methyl-1-pentyne-3-ol; epoxides such as glycidol, methyl glycidyl ether, allyl glycidyl ether, phenyl glycidyl ether, 1,2-butylene oxide, cyclohexene oxide and epichlorohydrin; ethers such as dimethyoxymethane, 1,2-dimethoxyethane, 1,4-dioxane and 1,3,5-trioxane; unsaturated hydrocarbons such as hexene, heptene, octene, 2,4,4-trimethyl-1-pentene, pentadiene, octadiene, cyclohexene and cyclopentene; olefinic alcohols such as allyl alcohol, 1-butene-3-ol and 3-methyl-1-butene-3-ol; acrylates such as methyl acrylate, ethyl acrylate and butyl acrylate; and the like. These stabilizers can be used alone or in an admixture. In addition, other compounds may be used together with the above stabilizers. In such case synergic stabilizing effect can be obtained. Examples of the other compounds are, for instance, phenols such as phenol, trimethylphenol, cyclohexylphenol, thymol, 2,6-di-t-butyl-4-methylphenol, butylhydroxyanisole and isoeugenol; amines such as hexylamine, pentylamine, dipropylamine, diisopropylamine, diisobutylamine, triethylamine, tributylamine, pyridine, N-methylmorpholine, cyclohexylamine, 2,2,6,6-tetramethylpyridine and N,N'-diallyl-p-phenylenediamine; and the like.

Amount of the stabilizers varies on kinds of the stabilizers, and is generally 0.1 to 10%, preferably 0.5 to 5% to the composition.

According to the present invention, there can be provided a mixed solvent of Flon-112, which can solve the disadvantages derived from the high freezing point of Flon-112 while maintaining the excellent properties similar to Flon-112, such as chemical stability, incombustibility, high boiling point, good cleaning power and safety against materials of rubbers or plastics.

The composition of the present invention is useful as a cleaning solvent for the above-mentioned temporary fixing waxes, and also-useful as an extraction solvent for bees wax and Japan wax. Further there can be advantageously used as a dispersing medium for powders such as carbon powder, silicon powder, ceramic powder and aluminium metal powder because the composition can form stable dispersions due to its high specific gravity. The composition can be preferably used as a solvent of paints and printing inks, as a kneading solvent of car waxes, and as a dispersing medium of liquid abrasives for boring.

The present invention is more specifically described and explained by means of the following Examples. It is to be understood that the present invention is not limited to the Examples and various changes and modifications may be made in the invention without departing from the spirit and scope thereof.

EXAMPLE 1

A distillation flask was charged with a mixture of Flon-112 and isooctane (90:10 by weight). The mixture was distilled under normal pressure by using a distillation tower having a theoritical plate number of 20 to obtain a distillate having a boiling point of 92.5° to 92.7° C. which is lower than the boiling points of Flon-112 and isooctane.

As the result of gaschromatography analysis, the distillate consisted of 95 to 93% of Flon-112 and 5 to 7% of isooctane.

EXAMPLE 2

A beaker was charged with 100 cc of the distillate obtained in Example 1 and was heated on a hot plate to boil the distillate. A silicon wafer of 2 inch diameter to which was adhered a sticky wax in polishing process as a temporary fixing wax was dipped into the boiling distillate for two minutes, and then washed the wafer by dipping it in the boiling distillate of the same composition.

The washed silicon wafer was observed with a microscope of 20 magnifications. There was no wax on the surface.

EXAMPLE 3

A beaker was charged with 100 cc of the disillate obtained in Example 1, and an active carbon which adsorbed bees wax was dipped thereto, and then allowed to stand for 5 minutes at a temperature of 90° to 93° C. After cooling, the active carbon was separated from the liquid phase, and the content of the bees wax in the liquid phase was measured. As the result 97% of the bees wax was extracted.

COMPARATIVE EXAMPLE 1

The same washing procedures as in Example 2 were repeated except that Flon-113 and a solvent containing Flon-113 such as an azeotropic mixed solvent of Flon-113/methylene chloride (50.5/49.5 by weight) were used instead of the distillate in Example 1. Almost of the sticky wax was not removed.

COMPARATIVE EXAMPLE 2

The same extraction procedures as in Example 3 were repeated except that Flon-112 was used instead of the distillate in Example 1. The active carbon could not be separated from Flon-112 which was solidified at the cooling because of its high freezing point.

What we claim is:

1. An azeotropic like composition comprising 95 to 93% by weight of tetrachlorodifluoroethane and 5 to 7% by weight of isooctane.

* * * * *